US012070057B2

(12) United States Patent
Shenton et al.

(10) Patent No.: US 12,070,057 B2
(45) Date of Patent: Aug. 27, 2024

(54) SUBSTITUTE SMOKING CONSUMABLE

(71) Applicant: NERUDIA LIMITED, Liverpool (GB)

(72) Inventors: Edward Ross Shenton, Liverpool (GB); Kate Ferrie, Liverpool (GB); Chris Lord, Liverpool (GB); David Jones, Liverpool (GB)

( * ) Notice: Subject to any disclaimer, the term of this patent is extended or adjusted under 35 U.S.C. 154(b) by 1056 days.

(21) Appl. No.: 16/987,819

(22) Filed: Aug. 7, 2020

(65) Prior Publication Data

US 2021/0015148 A1 Jan. 21, 2021

Related U.S. Application Data

(63) Continuation of application No. PCT/EP2019/053021, filed on Feb. 7, 2019, and a (Continued)

(30) Foreign Application Priority Data

Feb. 9, 2018 (GB) ..... 1802135
Feb. 9, 2018 (GB) ..... 1802136
(Continued)

(51) Int. Cl.
*A24D 1/20* (2020.01)
*A24F 40/20* (2020.01)
*A24F 40/46* (2020.01)

(52) U.S. Cl.
CPC ..... *A24D 1/20* (2020.01); *A24F 40/20* (2020.01); *A24F 40/46* (2020.01)

(58) Field of Classification Search
CPC ..... A24D 1/20; A24F 40/46; A24F 40/20
See application file for complete search history.

(56) References Cited

U.S. PATENT DOCUMENTS 5,095,921 A * 3/1992 Losee ..... A24F 1/00 131/194
5,135,009 A 8/1992 Mueller
(Continued)

FOREIGN PATENT DOCUMENTS

CN 103190706 A 7/2013
CN 103202540 A 7/2013
(Continued)

OTHER PUBLICATIONS

IP Office Japan, Notice of Reasons for Refusal for Application No. 2020-542763, Mail date: Apr. 4, 2023, English machine translation, 8 pages.
(Continued)

*Primary Examiner* — Christopher M Rodd
*Assistant Examiner* — Daniel Edward Vakili
(74) *Attorney, Agent, or Firm* — Perkins Coie LLP

(57) ABSTRACT

A heat not burn consumable (1) comprising a plant product (5) interspersed with a thermally conductive material in alternating layers such as radially or circumferentially alternating layers. The thermally conductive material may comprise at least one tubular element or may have a spiral configuration. The thermally conductive material may form spokes (4A-4E) within the plant product. A heating element may abut a first longitudinal end face (2) of the consumable (1) with a longitudinally-extending conductive element (6) which protruding axially from the longitudinal end face (2). The plant product (5) may have a smooth surface and the thermally conductive material (4) may be textured. The layers of thermally conductive material may have a grid configuration or a boustrophedonic configuration.

18 Claims, 4 Drawing Sheets

Related U.S. Application Data continuation of application No. PCT/EP2019/053024, filed on Feb. 7, 2019, and a continuation of application No. PCT/EP2019/053019, filed on Feb. 7, 2019, and a continuation of application No. PCT/EP2019/053022, filed on Feb. 7, 2019, and a continuation of application No. PCT/EP2019/053018, filed on Feb. 7, 2019.

(30) Foreign Application Priority Data

| | | |
|---|---|---|
| Feb. 9, 2018 | (GB) | 1802137 |
| Feb. 9, 2018 | (GB) | 1802138 |
| Feb. 9, 2018 | (GB) | 1802139 |
| Feb. 9, 2018 | (GB) | 1802140 |
| Feb. 9, 2018 | (GB) | 1802141 |
| Feb. 9, 2018 | (GB) | 1802142 |
| Feb. 9, 2018 | (GB) | 1802143 |
| Feb. 9, 2018 | (GB) | 1802144 |
| Feb. 9, 2018 | (GB) | 1802145 |
| Feb. 9, 2018 | (GB) | 1802146 |
| Feb. 9, 2018 | (GB) | 1802147 |

(56) References Cited

U.S. PATENT DOCUMENTS

| | | | | |
|---|---|---|---|---|
| 5,269,327 | A | 12/1993 | Counts et al. | |
| 8,430,106 | B2 * | 4/2013 | Potter | A24F 1/22 131/194 |
| 2010/0300467 | A1 | 12/2010 | Kuistila et al. | |
| 2015/0217068 | A1 | 8/2015 | Wakalopulos | |
| 2015/0223515 | A1 | 8/2015 | McCullough | |
| 2015/0223523 | A1 | 8/2015 | McCullough | |
| 2016/0295921 | A1 | 10/2016 | Mironov | |
| 2016/0310684 | A1 | 10/2016 | McCullough | |
| 2017/0006916 | A1 | 1/2017 | Liu | |
| 2017/0027233 | A1 | 2/2017 | Mironov | |
| 2017/0055576 | A1 * | 3/2017 | Beeson | A24F 47/00 |
| 2017/0055584 | A1 | 3/2017 | Blandino et al. | |
| 2017/0105455 | A1 | 4/2017 | Qiu | |
| 2017/0119049 | A1 | 5/2017 | Blandino et al. | |

FOREIGN PATENT DOCUMENTS

| | | | |
|---|---|---|---|
| CN | 103859597 | A | 6/2014 |
| CN | 104997164 | A | 10/2015 |
| CN | 105054297 | A | 11/2015 |
| CN | 204838004 | U | 12/2015 |
| CN | 204888735 | U | 12/2015 |
| CN | 105852224 | A | 8/2016 |
| CN | 107373749 | | 11/2017 |
| CN | 107373761 | A | 11/2017 |
| CN | 107373768 | A | 11/2017 |
| CN | 107373770 | A | 11/2017 |
| CN | 107373778 | A | 11/2017 |
| CN | 107411178 | A | 12/2017 |
| EP | 0488488 | A1 | 6/1992 |
| EP | 0503767 | A1 | 9/1992 |
| GB | 2547699 | A | 8/2017 |
| JP | 5015269 | B2 | 8/2012 |
| JP | 6218803 | B2 | 10/2017 |
| WO | 2008015441 | A1 | 2/2008 |
| WO | 2010/113702 | A1 | 10/2010 |
| WO | 2013098395 | A1 | 7/2013 |
| WO | 2013/131763 | A1 | 9/2013 |
| WO | 2013/178768 | A1 | 12/2013 |
| WO | 2015/155289 | A1 | 10/2015 |
| WO | 2016118005 | A1 | 7/2016 |
| WO | 2017040608 | A2 | 3/2017 |
| WO | 2017122196 | A1 | 7/2017 |
| WO | 2018003871 | A1 | 1/2018 |

OTHER PUBLICATIONS

IP Office Japan, Notice of Reasons for Refusal for Application No. 2020-542768, Mail date: Mar. 28, 2023, English machine translation, 5 pages.

IP Office Japan, Notice of Reasons for Refusal for Application No. 2020-542772, Mail date: Apr. 4, 2023, English machine translation, 6 pages.

IP Office Japan, Notice of Reasons for Refusal for Application No. 2020-542807, Mail date: Jan. 10, 2023, English machine translation, 4 pages.

Combined Search and Examination Report under Sections 17 and 18(3) for Application No. GB1802140.2, dated Jul. 2, 2018, 6 pages.

Combined Search and Examination Report under Sections 17 and 18(3) for Application No. GB1802143.6, dated Jul. 2, 2018, 8 pages.

Combined Search and Examination Report under Sections 17 and 18(3) for Application No. GB1802142.8, dated Jul. 2, 2018, 9 pages.

Combined Search and Examination Report under Sections 17 and 18(3) for Application No. GB1802139.4, dated Jun. 29, 2018, 8 pages.

Combined Search and Examination Report under Sections 17 and 18(3) for Application No. GB1802141.0, dated Jun. 28, 2018, 9 pages.

Combined Search and Examination Report under Sections 17 and 18(3) for Application No. GB1802138.6, dated Jun. 28, 2018, 7 pages.

Combined Search and Examination Report under Sections 17 and 18(3) for Application No. GB1802137.8, dated Jun. 28, 2018, 11 pages.

Combined Search and Examination Report under Sections 17 and 18(3) for Application No. GB1802136.0, dated Jun. 28, 2018, 11 pages.

Combined Search and Examination Report under Sections 17 and 18(3) for Application No. GB1802135.2, dated Jun. 28, 2018, 10 pages.

Combined Search and Examination Report under Sections 17 and 18(3) for Application No. GB1802147.7, dated Jun. 26, 2018, 6 pages.

Combined Search and Examination Report under Sections 17 and 18(3) for Application No. GB1802146.9, dated Jun. 25, 2018, 10 pages.

Combined Search and Examination Report under Sections 17 and 18(3) for Application No. GB1802144.4, dated Jul. 2, 2018, 5 pages.

International Search Report and Written Opinion for International Application No. PCT/EP2019/053024, dated Jun. 11, 2019, 12 pages.

International Preliminary Report on Patentability for International Application No. PCT/EP2019/053024, dated Aug. 11, 2020, 7 pages.

International Preliminary Report on Patentability for International Application No. PCT/EP2019/053022, dated Aug. 11, 2020, 10 pages.

International Search Report and Written Opinion for International Application No. PCT/EP2019/053022, dated Sep. 23, 2019, 16 pages.

International Search Report and Written Opinion for International Application No. PCT/EP2019/053021, dated Sep. 25, 2019, 17 pages.

International Preliminary Report on Patentability for International Application No. PCT/EP2019/053021, dated Aug. 11, 2020, 10 pages.

International Search Report and Written Opinion for International Application No. PCT/EP2019/053019, dated Jun. 11, 2019, 11 pages.

International Preliminary Report on Patentability for International Application No. PCT/EP2019/053019, dated Aug. 11, 2020, 6 pages.

International Preliminary Report on Patentability for International Application No. PCT/EP2019/053018, dated Aug. 11, 2020, 7 pages.

(56) References Cited

OTHER PUBLICATIONS

International Search Report and Written Opinion for International Application No. PCT/EP2019/053018, dated Jun. 4, 2019, 12 pages.

* cited by examiner

SUBSTITUTE SMOKING CONSUMABLE

CROSS-REFERENCE TO RELATED APPLICATION(S)

This application is a continuation of International Patent Application Numbers PCT/EP2019/053018, PCT/EP2019/053019, PCT/EP2019/053021, PCT/EP2019/053022, and PCT/EP2019/053024, all filed Feb. 7, 2019, which collectively claim the benefit of the following Great Britain Patent Applications: 1802135.2, 1802136.0, 1802137.8, 1802138.6, 1802139.4, 1802140.2, 1802141.0, 1802142.8, 1802143.6, 1802144.4, 1802145.1, 1802146.9, and 1802147.7, all filed Feb. 9, 2018. All of these applications are incorporated herein by reference.

TECHNICAL FIELD

The present invention relates to a consumable for a smoking substitute device. In particular, but not exclusively, to a heat not burn consumable comprising tobacco. It also relates to a heat not burn system comprising a consumable and a heating element.

BACKGROUND

The "smoking" of tobacco is generally considered to expose a smoker to potentially harmful substances. It is generally thought that a significant amount of the potentially harmful substances are generated through the heat caused by the burning and/or combustion of the tobacco and the constituents of the burnt tobacco in the tobacco smoke itself.

Combustion of organic material such as tobacco is known to produce tar and other potentially harmful by-products. There have been proposed various smoking substitute devices in order to avoid the smoking of tobacco.

Such substitute devices can form part of nicotine replacement therapies aimed at people who wish to stop smoking and overcome a dependence on nicotine.

Substitute devices may comprise electronic systems that permit a user to simulate the act of smoking by producing an aerosol that is drawn into the lungs through the mouth (inhaled) and then exhaled. The inhaled aerosol typically bears nicotine and/or flavourings without, or with fewer of, the odour and health risks associated with traditional smoking.

In general, substitute devices and systems are intended to provide a substitute for the rituals of smoking, whilst providing the user with a similar experience and satisfaction to those experienced with traditional smoking and tobacco products.

The popularity and use of smoking-substitute devices has grown rapidly in the past few years. Although originally marketed as an aid to assist habitual smokers wishing to quit tobacco smoking, consumers are increasingly viewing smoking substitute devices as desirable lifestyle accessories. Some substitute devices are designed to resemble a traditional cigarette and are cylindrical in form with a mouthpiece at one end. Other substitute devices do not generally resemble a cigarette (for example, the substitute device may have a generally box-like form).

There are a number of different categories of substitute systems, each utilising a smoking substitute approach. A substitute approach corresponds to the manner in which the substitute system operates for a user.

An approach for a substitute system is the so-called "heat not burn" (HNB) approach in which tobacco, whether leaf tobacco or reconstituted tobacco, is heated or warmed to release vapour. The vapour may contain nicotine and/or flavour(s). In the HNB approach the intention is that the tobacco is not burned and does not undergo combustion.

In general, an HNB system includes a heating device and consumable. The consumable includes the tobacco material. The consumable is configured for engagement with the heating device. During use, heat is imparted to the tobacco material from a heat source of the heating device. Air flow through the tobacco material causes moisture in the tobacco material to be released as vapour. A first vapour may thus be formed from a carrier in the tobacco material, for example polyglycol (PG) or vegetable glycerine (VG). In addition, volatile compounds may also be released from the tobacco as a second vapour. The vapour(s) released from the tobacco are entrained in the airflow drawn through the tobacco.

As the vapours pass through the device (entrained in the airflow) from an inlet to a mouthpiece (outlet), the vapours cool and condense to form an aerosol for inhalation by the user. The aerosol contains the volatile compounds.

In HNB systems, heating as opposed to burning the tobacco material is believed to cause fewer, or smaller quantities, of the more harmful compounds ordinarily produced during smoking. Consequently, the HNB approach may reduce the odour and/or health risks that can arise through the burning, combustion and pyrolytic degradation of tobacco.

A first existing implementation of the HNB approach is the IQOS™ device from Philip Morris Ltd. The IQOS™ device uses a consumable element, including reconstituted tobacco contained within a metallic foil and paper wrapper. The consumable element may be inserted into a heater device. The heater device has a thermally conductive heating knife which penetrates the reconstituted tobacco of the consumable element, when the consumable element is inserted into the heating device. Activation of the heating device heats the heating element, which, in turn, heats the tobacco in the consumable element. The heating of the tobacco causes it to release nicotine vapour and flavours which may be drawn through the mouthpiece by the user through inhalation.

A second existing implementation of the HNB approach is the device known as Glo™ from British American Tobacco. Glo™ comprises a relatively thin consumable element. The consumable element includes paper reconstituted tobacco which is heated in a heating device. When the consumable element is placed in the heating device, the tobacco is surrounded by a heating element. Activation of the heating device heats the heating element, which, in turn, heats the tobacco in the consumable element. The heating of the tobacco causes it to release nicotine vapour and flavours which may be drawn through the consumable element by the user through inhalation. The tobacco, when heated by the heating device, is configured to produce vapour when heated rather than when burned (as in a traditional cigarette). The tobacco may contain high levels of aerosol formers (carrier), such as vegetable glycerine ("VG") or propylene glycol ("PG").

Common to both the IQOS™ and Glo™ devices is uneven and incomplete heating of the tobacco, or possible burning of some regions of the tobacco.

Aspects and embodiments of the invention were devised with the foregoing in mind.

SUMMARY

In a first aspect, there is provided a heat not burn (HNB) consumable comprising a plant product interspersed with a thermally conductive material, wherein a transverse cross-section through the consumable comprises alternating layers of the plant product and the thermally conductive material.

The alternating layers provide a regular, ordered arrangement of plant product and thermally conductive material so that it is possible to provide a more even heating of the plant product. This reduces burning and incomplete heating of the plant product by ensuring that each layer of plant product is heated in a controlled manner by its adjacent layer(s) of thermally conductive material.

The term "transverse cross section" is used to denote a cross section through the consumable perpendicular to the longitudinal axis/length of the consumable (which is typically rod-shaped). The consumable has opposing longitudinal end faces which will each comprise a transverse cross section.

In preferred embodiments, the adjacent layers of the plant product and the thermally conductive material within the alternating layers are in abutment with one another i.e. there is no spacing (e.g. no air gap) between adjacent layers of plant product and thermally conductive material.

In some embodiments, the thermally conductive material may comprise at least one laminar sheet having a planar heating surface extending (without any transverse folds) in a longitudinal direction through the consumable. A planar heating surface (for contact with the plant product) helps ensure even transfer of heat to the plant product.

In some embodiments, the plant product may comprise at least one laminar sheet having a planar surface extending in a longitudinal direction through the consumable.

In some embodiments, the consumable comprise a plurality of laminar sheets of thermally conductive material. The laminar sheet(s) may be longitudinally folded or rolled to form the layers of thermally conductive material within the transverse cross-section.

Accordingly, there is provided a heat not burn (HNB) consumable comprising a plant product and at least one longitudinally-extending laminar sheet of thermally conductive material, wherein the at least one laminar sheet comprises a plurality of longitudinal folds (and preferably no transverse folds) and wherein each of the plurality of longitudinal folds has a rounded apex.

By ensuring that the longitudinal folds have rounded (rather than sharp) apices, burning of the plant product in the apices is avoided since the rounded apices increase the spacing of the adjacent layers of the laminar sheet thus allowing more even and controlled heating of the plant product.

There is also provided a heat not burn (HNB) consumable comprising a plant product and at least one longitudinally-extending laminar sheet of thermally conductive material, wherein the at least one laminar sheet comprises a plurality of longitudinal folds (preferably each with a rounded apex) and no transverse folds.

In some embodiments of the first aspect, a plurality of laminar sheets each having a planar heating surface may be provided to from the layers of thermally conductive material within the transverse cross section.

In some embodiments, the transverse cross-section through the consumable will comprise radially alternating layers of the plant product and the thermally conductive material.

A preferred embodiment comprises a heat not burn (HNB) consumable comprising the plant product interspersed with the thermally conductive material, wherein both the plant product and the thermally conductive material have a spiral configuration in a transverse cross-section through the consumable, the spiral cross sections being interleaved with one another.

For example, the laminar sheet may be rolled into a spiral form such that the thermally conductive material has a spiral configuration in the transverse cross section. The plant product will also have a spiral configuration in the transverse cross section, the spiral cross-sections of thermally conductive material and plant product being interleaved with one another (as in Swiss roll).

In some embodiments, the consumable comprises a plurality of (e.g. two) laminar sheets of thermally conductive material rolled into a plurality of interleaved spiral configurations of thermally conductive material which are then interleaved with a plurality of (e.g. two) spirally formed portions of plant product.

It is preferred that the radial spacing (i.e. the transverse spacing in a radial direction) between at least three adjacent spiral layers of thermally conductive material and more preferably that the radial spacing between substantially all of the spiral layers of thermally conductive material is substantially equal in the transverse cross section of the consumable. Furthermore, it is preferred that the radial spacing between at least two adjacent and more preferably substantially all of the spiral layers of thermally conductive material remains substantially equal along a major portion of the longitudinal axis/length of the consumable. The equal spacing helps ensure an even and controlled heat transfer to the plant product.

In other embodiments having radially alternating layers of the plant product and the thermally conductive material in the transverse cross section, the thermally conductive material comprises at least one longitudinally-extending tubular element.

Accordingly, there is provided a heat not burn (HNB) consumable comprising a plant product interspersed with a thermally conductive material, wherein the thermally conductive material comprises at least one longitudinally-extending tubular element, e.g. formed from a rolled laminar sheet of thermally conductive material. In these embodiments, the thermally conductive material will have a circular transverse cross section.

Preferably, the consumable comprises a plurality of tubular elements of thermally conductive material. Preferably the tubular elements are axially aligned such that, in the transverse cross section, the thermally conductive material forms a series of concentric rings alternating with concentric rings of plant product.

It is preferred that the radial spacing (i.e. the transverse spacing in a radial direction) between at least three adjacent rings of thermally conductive material and more preferably that the radial spacing between substantially all of the rings of thermally conductive material is substantially equal in the transverse cross section of the consumable. Furthermore, it is preferred that the radial spacing between at least two adjacent and more preferably substantially all of the tubular elements of thermally conductive material remains substantially equal along a major portion of the longitudinal axis/length of the consumable.

In some embodiments, the transverse cross-section through the consumable comprises stacked (e.g. vertically and/or horizontally stacked) alternating layers of the plant product and the thermally conductive material.

In one example, the thermally conductive material has a boustrophedonic (e.g. serpentine or concertina or saw-tooth) configuration in the transverse cross-section through the consumable.

In the serpentine configuration, the at least one laminar sheet will be formed to comprise a series of stacked longitudinally-extending planar layers separated/spaced at their transverse edges by a series of longitudinally extending folds in the laminar sheet(s).

Preferably, each of the plurality of longitudinal folds has a rounded apex.

It is preferred that the spacing between at least three adjacent planar layers of thermally conductive material and more preferably that the spacing between substantially all of the planar layers of thermally conductive material is substantially equal in the transverse cross section of the consumable. Furthermore, it is preferred that the spacing between at least two adjacent and more preferably substantially all of the planar layers of thermally conductive material remains substantially equal along a major portion of the longitudinal axis/length of the consumable. The spacing may be between 0.1 and 0.5 mm.

In other embodiments, the consumable comprises a plurality of laminar sheets of thermally conductive material stacked (e.g. vertically or horizontally stacked) and interspersed with plant product such that the thermally conductive material and plant product have a laminated configuration in the transverse cross-section of the consumable.

Accordingly, there is provided a heat not burn (HNB) consumable comprising a plant product and a thermally conductive material, wherein the thermally conductive material comprises a plurality of stacked, longitudinally-extending laminar sheets interspersed with plant product.

It is preferred that the spacing between at least three adjacent laminar sheets of thermally conductive material and more preferably that the spacing between substantially all of the laminar sheets of thermally conductive material is substantially equal in the transverse cross section of the consumable. Furthermore, it is preferred that the spacing between at least two adjacent and more preferably substantially all of the laminar sheets of thermally conductive material remains substantially equal along a major portion of the longitudinal axis/length of the consumable. The spacing may be between 0.1 and 0.5 mm.

In some embodiments, the consumable comprises a first plurality of stacked (e.g. vertically stacked) laminar sheets of thermally conductive material and a second plurality of stacked (e.g. horizontally stacked) laminar sheets of thermally conductive material interspersed with plant product. The laminar sheets intersect to form a grid in the transverse cross section of the consumable.

Accordingly, there is provided a heat not burn (HNB) consumable comprising a plant product and a thermally conductive material, wherein the thermally conductive material comprises a first plurality of stacked, longitudinally-extending laminar sheets and a second plurality of stacked, longitudinally extending laminar sheets, the first and second plurality of laminar sheets intersecting each other to form a grid of thermally conductive material interspersed with plant product in a transverse cross section of the consumable.

It is preferred that the spacing between the first plurality of (vertically) stacked laminar sheets is substantially equal in the transverse cross section of the consumable. It is preferred that the spacing between the second plurality of (horizontally) stacked laminar sheets is substantially equal in the transverse cross section of the consumable. Furthermore, it is preferred that the spacing remains substantially equal along a major portion of the longitudinal axis/length of the consumable. The spacing may be between 0.1 and 0.5 mm.

In some embodiments, the transverse cross-section through the consumable comprises circumferentially alternating layers of the plant product and the thermally conductive material.

For example, the thermally conductive material may comprises a plurality of radially and longitudinally extending laminar sheets.

Accordingly, there is provided a heat not burn (HNB) consumable comprising a plant product interspersed with a thermally conductive material, wherein the thermally conductive material comprises a plurality of radially and longitudinally extending laminar sheets.

For example, there may be at least five radially and longitudinally extending laminar sheets of thermally conductive material.

Each laminar sheet of thermally conductive material may extend from an inner hub at the axial centre of the consumable to proximal an outer perimeter of the consumable (in a spoke configuration).

It is preferred that the laminar sheets of thermally conductive material are equally spaced around the axial hub i.e. the angular separation between the laminar sheets in a transverse cross section of the consumable is equal.

In a second aspect, there is provided a heat not burn (HNB) consumable comprising a plant product interspersed with a thermally conductive material, wherein a transverse cross-section through the consumable comprises layers of the plant product and the thermally conductive and wherein a transverse spacing between two adjacent layers of thermally conductive material is substantially equal along a major portion of the longitudinal axis/length (e.g. along the entire length) of the consumable.

The equal spacing between at least two adjacent layers along the length of the consumable provides a more even heating of the plant product thus reducing burning and incomplete heating of the plant product by ensuring that each layer of plant product is heated in a controlled manner by its adjacent layers of thermally conductive material.

Preferably, the transverse spacing between substantially all adjacent layers of thermally conductive material is substantially equal along a major portion of the longitudinal axis (e.g. along the entire length) of the consumable.

Most preferably the transverse spacing between substantially all adjacent layers of thermally conductive material is substantially equal in a transverse cross-section through the consumable.

In preferred embodiments, the adjacent layers of the plant product and the thermally conductive material are in abutment with one another i.e. there is no spacing (e.g. no air gap) between adjacent layers of plant product and thermally conductive material.

The first and second aspects may be combined. Embodiments of the first aspect having equal spacing according to the second are described above.

In some embodiments of the first and second aspects, the consumable further comprises an axially-/longitudinally-extending conductive element (e.g. rod) formed of the or a further thermally conductive material. It may be provided at the axial centre of the consumable.

In preferred embodiments, the conductive element is thermally coupled to the at least one or at least one of the plurality of laminar sheets of thermally conductive material. For example, the or each laminar sheet may comprise a longitudinally-extending edge which may be thermally coupled e.g. joined to the conductive element. It many form an inner hub from which the spirally-formed laminar sheet(s) of thermally conductive material depend. It may form the inner hub from which the radially and longitudinally extending laminar sheets (spokes) radiate.

The conductive element preferably extends to the first longitudinal end face of the consumable e.g. for abutment of a longitudinal end face of the conductive element with the heating element in the eighth or ninth aspects described below.

In other embodiments, the conductive element protrudes axially from the longitudinal end face.

In a third aspect, there is provided a heat not burn (HNB) consumable comprising a plant product interspersed with a thermally conductive material, wherein the thermally conductive material comprises a longitudinally-extending conductive element which protrudes axially from a first longitudinal end face of the consumable.

By providing an axially-/longitudinally-extending conductive element (e.g. rod), it is possible for a heating element of a heating device to radially heat the protruding end of the conductive element so that heating can be effected more quickly and the heat from the conductive element can be transferred to the plant product radially from the heated conductive element.

The thermally conductive material may further comprise at least one laminar sheet of the or a further thermally conductive material as described above for the first aspect. The laminar sheet(s) may be arranged such that the transverse cross-section of the consumable comprises alternating layers of the or the further thermally conductive material as described above for the first aspect. The layers may be equally spaced as described above for the second aspect. Adjacent layers of plant of plant product or material I/thermally conductive material may be in intimate contact (e.g. in abutment) such that there is no spacing (e.g. no air gap) between adjacent layers.

The at least one laminar sheet may be thermally coupled to the conductive element as described above for the first and second aspects.

The conductive element may be a conductive rod having a circular or oval transverse cross-section.

The consumable of the third aspect may be coupled with a heating element in a heat not burn system wherein the heating element surrounds (e.g. encircles or encloses) the protruding conductive element. The consumable has a first longitudinal end face and the heating element may abut the first longitudinal end face of the consumable.

In some embodiments of the first, second or third aspects, the or each laminar sheet of thermally conductive material may have a textured or discontinuous surface and the plant product may comprise one or more laminar sheets (i.e. longitudinally-extending laminar sheets) which have a substantially smooth surface.

For example, the or each laminar sheet of thermally conductive material may have an apertured/perforated, dimpled or recessed surface.

Additionally or alternatively, the or each laminar sheet of thermally conductive material may have protrusions or ridges. For example, the or each laminar sheet of thermally conductive material may be crimped.

In other examples, the or each laminar sheet of thermally conductive material may comprise perforations or dimples, each being at least partially surrounded/encircled (e.g. fully surrounded/encircled) by a ridge/protrusion (e.g. a protruding circular ring). This helps maximise airflow through the consumable on vaporisation.

In a fourth aspect, there is provided a heat not burn (HNB) consumable comprising at least one laminar sheet of plant product and at least one laminar sheet of thermally conductive material, wherein a surface of the at least one sheet of plant product is substantially smooth and wherein a surface of the at least one sheet of thermally conductive material is textured.

By providing a textured or discontinuous surface on the at least one laminar sheet of thermally conductive material and a smooth surface on the at least one laminar sheet of plant product, the thermal contact between the two abutting surfaces can be increased (e.g. by indentation of the plant product with protrusions/ridges on the thermally conductive material and/or penetration of apertures/dimples on the at least one laminar sheet of thermally conductive material by the plant product.)

As described above, the or each laminar sheet of thermally conductive material may have an apertured/perforated, dimpled or recessed surface.

Additionally or alternatively, the or each laminar sheet of thermally conductive material may have protrusions or ridges. For example, the or each laminar sheet of thermally conductive material may be crimped.

In other examples, the or each laminar sheet of thermally conductive material may comprise perforations or dimples, each being at least partially surrounded/encircled (e.g. fully surrounded/encircled) by a ridge/protrusion (e.g. a protruding circular ring).

The or each laminar sheet of plant product is substantially smooth i.e. it does not comprise any apertures/perforations, dimples, ridges or protrusions visible to the naked eye. It may comprise a laminar sheet of reconstituted tobacco. Alternatively, it may comprise a laminar sheet of at least one least one plant product selected from the list including *Amaranthus dubius, Arctostaphylos uva-ursi* (Bearberry), *Argemone mexicana, Arnica, Artemisia vulgaris*, Yellow Tees, *Calea zacatechichi, Canavalia maritima* (Baybean), *Cecropia mexicana* (Guamura), *Cestrum nocturnum, Cynoglossum virginianum* (wild comfrey), *Cytisus scoparius, Damiana, Entada rheedii, Eschscholzia californica* (California Poppy), *Fittonia albivenis, Hippobroma longiflora, Humulus japonica* (Japanese Hops), *Humulus lupulus* (Hops), *Lactuca virosa* (Lettuce Opium), *Laggera alata, Leonotis leonurus, Leonurus cardiaca* (Motherwort), *Leonurus sibiricus* (Honeyweed), *Lobelia cardinalis, Lobelia inflata* (Indian-tobacco), *Lobelia siphilitica, Nepeta cataria* (Catnip), *Nicotiana* species (Tobacco), *Nymphaea alba* (White Lily), *Nymphaea caerulea* (Blue Lily), Opium poppy, *Passiflora incarnata* (Passionflower), *Pedicularis densiflora* (Indian Warrior), *Pedicularis groenlandica* (Elephant's Head), *Salvia divinorum, Salvia dorrii* (Tobacco Sage), *Salvia* species (Sage), *Scutellaria galericulata, Scutellaria lateriflora, Scutellaria nana, Scutellaria* species (Skullcap), *Sida acuta* (Wireweed), *Sida rhombifolia, Silene capensis, Syzygium aromaticum* (Clove), *Tagetes lucida* (Mexican Tarragon), *Tarchonanthus camphoratus, Turnera diffusa* (Damiana), *Verbascum* (Mullein), *Zornia latifolia* (Maconha Brava) together with any combinations, functional equivalents to, and/or synthetic alternatives of the foregoing.

The or each laminar sheet of thermally conductive material may have any of the configurations (e.g. spiral, concentric rings, serpentine, stacked, reticulated, radially extending) described above for the first aspect in a transverse cross section through the consumable. It/they may form layers having the equal spacing described above for the second aspect.

In preferred embodiments, the adjacent layers of the plant product and the thermally conductive material within the alternating layers are in abutment with one another i.e. there is no spacing (e.g. no air gap) between adjacent layers of plant product and thermally conductive material.

In preferred embodiments, the at least one laminar sheet of plant product and at least one laminar sheet of thermally conductive material, are in intimate contact (e.g. in abutment) such that there is no spacing (e.g. no air gap) therebetween.

In a fifth aspect, there is provided a heat not burn (HNB) consumable comprising a plant product interspersed with a thermally conductive material, wherein the thermally conductive material is configured such that burning of the plant product is minimised.

In some embodiments, the thermally conductive material is configured such that less than 10% and preferably less than 5% of plant product is burned (e.g. after heating in a heating device for 5 minutes). The mass of burned plant product can be detected from the mass of char present in the consumable after heating.

The fifth aspect may be combined with any other aspect. In particular, the consumable may have the features defined for the first aspect. It may have the equal spacing defined for the second aspect.

In a sixth aspect, there is provided a heat not burn (HNB) consumable comprising a plant product interspersed with a thermally conductive material, wherein the thermally conductive material is configured such that the amount of unspent plant product present after heating is minimised.

In some embodiments, the thermally conductive material is configured such that less than 10% and preferably less than 5% of unspent plant product remains (e.g. after heating in a heating device for 5 minutes). The mass of unspent plant product can be detected from the amount of active substance remaining in the consumable after heating.

The sixth aspect may be combined with any other aspect. In particular, the consumable may have the features defined for the first aspect. It may have the equal spacing defined for the second aspect.

In a seventh aspect, there is provided a heat not burn (HNB) consumable comprising a plant product interspersed with a thermally conductive material, wherein the thermally conductive material is configured such that the thermal gradient in a transverse and/or longitudinal cross section through the consumable is less than or equal to 50° C., e.g. less than or equal to 40° C., such as less than or equal to 30° C. or 20° C., for example less than or equal to 10° C. after heating in a heating device for 5 minutes.

The seventh aspect may be combined with any other aspect. In particular, the consumable may have the features defined for the first aspect. It may have the equal spacing defined for the second aspect.

Embodiments of the fifth to seventh aspects may be obtained by providing the thermally conductive material as described above for one or more of the first to fourth aspects.

In an eighth aspect, there is provided a heat not burn (HNB) system comprising:

a heat not burn consumable according to any one or more of the first to seventh aspects;

and a heating element, wherein the heating element abuts the/a first longitudinal end face of the consumable.

The heating element may comprise a planar surface that abuts the longitudinal end face of the consumable.

The outer surface of the consumable (which may comprise a wrapper such as a paper wrapper) may comprise a tubular sheath formed of the or a further thermally conductive material.

The heating element may further comprise a tubular portion which encircles and heats the tubular sheath to transfer heat radially inwards.

The heating element may further comprise a recessed portion for receiving and radially heating the protruding conductive element.

In a ninth aspect, there is provided a heat not burn (HNB) system comprising:

a heat not burn consumable having a having a first longitudinal end face, the consumable comprising a plant product interspersed with a thermally conductive material; and a heating element, wherein the heating element abuts the first longitudinal end face of the consumable.

By providing a heating element that abuts the longitudinal end face of the consumable, it is possible to provide axial heating to the thermally conductive material so that plant product at the radially outermost portions of the consumable is heated to the same extent as plant product at the radially innermost portions of the consumable to ensure even heating.

The consumable may be as described for any one or more of the first to seventh aspects.

In preferred embodiments, the thermally conductive material extends to the first longitudinal end face for thermal abutment with the heating element.

In some embodiments, the thermally conductive material is exposed at the first longitudinal end face for thermal abutment with the heating element.

For example, the or each laminar sheet of thermally conductive material may have a transverse edge which may extend to and may be exposed at the longitudinal end face of the consumable.

At the first longitudinal end face, the transverse edge of the or each laminar sheet of thermally conductive material may have any of the configurations (e.g. spiral, concentric rings, serpentine, stacked, reticulated, radially extending) described above for the first aspect. It/they may form layers at the longitudinal end face of the consumable having the equal spacing described above for the second aspect.

The heating element preferably comprises a planar heating surface for abutment with the first longitudinal end face of the consumable/the transverse edge(s) of the or each laminar sheet of thermally conductive material.

The outer surface of the consumable (which may comprise a wrapper such as a paper wrapper) may comprise a tubular sheath formed of the or a further thermally conductive material.

The heating element may further comprise a tubular portion which encircles and heats the tubular sheath to transfer heat radially inwards.

The heating element may further comprise a recessed portion for receiving and radially heating the protruding conductive element.

The invention includes the combination of the aspects and preferred features described except where such a combination is clearly impermissible or expressly avoided.

In any of the aspects described above, the thermally conductive material, the further thermally conductive material or the yet further thermally conductive material may be selected from the group consisting of: carbon or metal/metal alloy such as aluminum; brass; copper; gold; steel; silver; an alloy of one of more thereof; or a mixture of two or more thereof.

In any of the aspects described above, the plant product may be derived or obtained from at least one plant from which an active substance may be aerosolized into a breathable fluid stream for inhalation by a user. Suitable plant products include *Amaranthus dubius, Arctostaphylos uva-ursi* (Bearberry), *Argemone mexicana, Arnica, Artemisia vulgaris*, Yellow Tees, *Calea zacatechichi, Canavalia maritima* (Baybean), *Cecropia mexicana* (Guamura), *Cestrum nocturnum, Cynoglossum virginianum* (wild comfrey), *Cytisus scoparius, Damiana, Entada rheedii, Eschscholzia californica* (California Poppy), *Fittonia albivenis, Hippobroma longiflora, Humulus japonica* (Japanese Hops), *Humulus lupulus* (Hops), *Lactuca virosa* (Lettuce Opium), *Laggera alata, Leonotis leonurus, Leonurus cardiaca* (Motherwort), *Leonurus sibiricus* (Honeyweed), *Lobelia cardinalis, Lobelia inflata* (Indian-tobacco), *Lobelia siphilitica, Nepeta cataria* (Catnip), *Nicotiana* species (Tobacco), *Nymphaea alba* (White Lily), *Nymphaea caerulea* (Blue Lily), Opium poppy, *Passiflora incarnata* (Passionflower), *Pedicularis densiflora* (Indian Warrior), *Pedicularis groenlandica* (Elephant's Head), *Salvia divinorum, Salvia dorrii* (Tobacco Sage), *Salvia* species (Sage), *Scutellaria galericulata, Scutellaria lateriflora, Scutellaria nana, Scutellaria* species (Skullcap), *Sida acuta* (Wireweed), *Sida rhombifolia, Silene capensis, Syzygium aromaticum* (Clove), *Tagetes lucida* (Mexican Tarragon), *Tarchonanthus camphoratus, Turnera diffusa* (Damiana), *Verbascum* (Mullein), *Zornia latifolia* (Maconha Brava) together with any combinations, functional equivalents to, and/or synthetic alternatives of the foregoing.

In some embodiments, the plant product may be reconstituted tobacco.

As referred to herein, the term "active substance" denotes a chemical and/or physiologically active species, or combination or mixture of such chemical and/or physiologically species, that are intended to be aerosolized, and that may provide the user with a recreational and/or medicinal effect when a breathable fluid stream comprising the aerosol is inhaled by a user. Suitable chemical and/or physiologically active species includes the group consisting of: nicotine, cocaine, caffeine, opiates and opioids, cathine and cathinone, kavalactones, myristicin, beta-carboline alkaloids, salvinorin A together with any combinations, functional equivalents to, and/or synthetic alternatives of the foregoing.

The plant product may include entrained particles of the, the further or a yet further thermally conductive material selected from those listed above.

In preferred embodiments of each/any of the above aspects, the plant product and the thermally conductive material are in intimate contact i.e. in abutment with each other. In other words, there is preferably no spacing (e.g. no air gap) between the plant product and thermally conductive material.

BRIEF DESCRIPTION OF THE DRAWINGS

So that the invention may be more readily understood, and so that further features thereof may be appreciated, embodiments and experiments illustrating the principles of the invention will now be described by way of example with reference to the accompanying figures in which.

DETAILED DESCRIPTION

Aspects and embodiments of the present invention will now be discussed with reference to the accompanying figures. Further aspects and embodiments will be apparent to those skilled in the art. All documents mentioned in this text are incorporated herein by reference.

In general, the present invention is directed to an HNB consumable. The HNB consumable forms a constituent element of an HNB system. An HNB consumable according to the present invention is configured for use with a heating device having a heating element. In combination, an HNB consumable and a heating device form an HNB system. The HNB consumable may be configured for engagement with the heating device.

Figure 1:
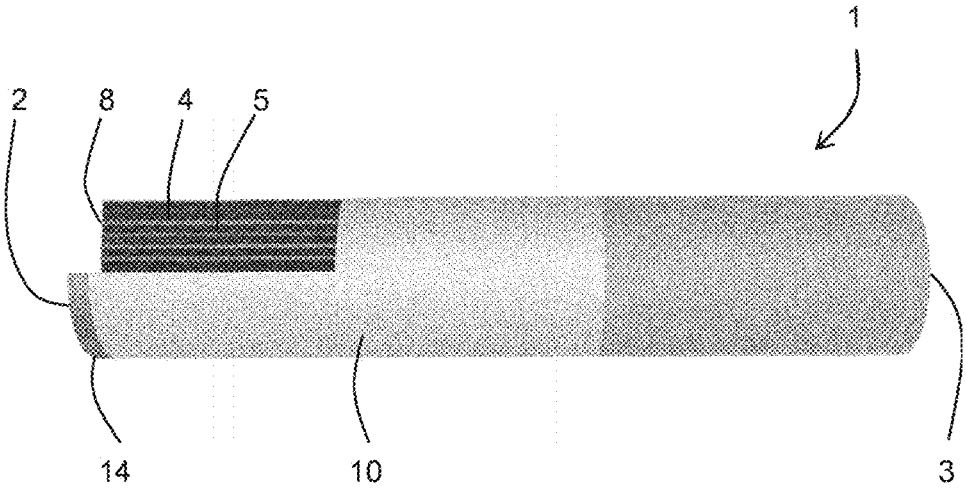
FIG. 1 shows a side view of a first embodiment having a spiral configuration.
Figure 2:
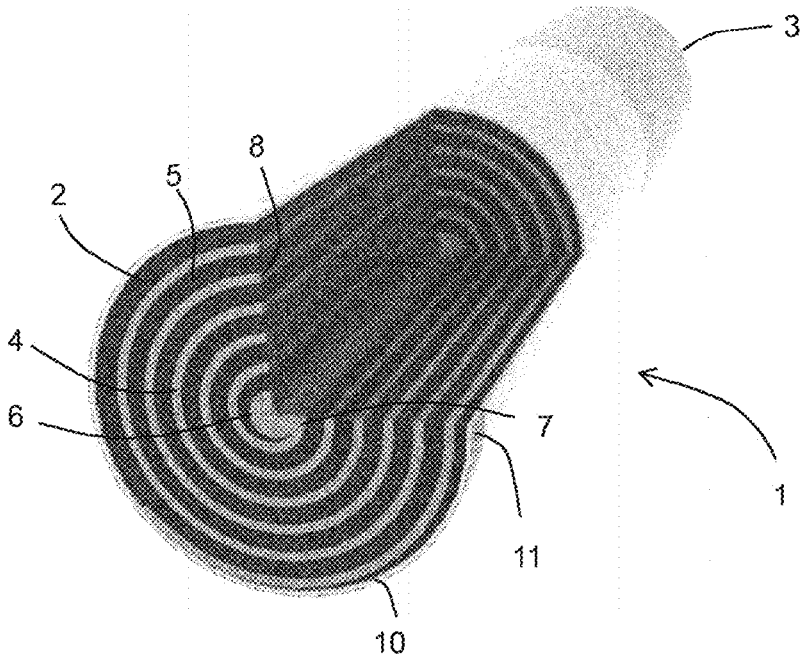
FIG. 2 shows a perspective view of the first embodiment.

FIGS. 1 and 2 show an HNB consumable 1 according to a first embodiment.

The consumable 1 has an elongate shape. In other words, the consumable has a longitudinal dimension (length) along a longitudinal axis that is larger than a dimension of the consumable along a transverse axis of the consumable.

The consumable 1 has a transverse cross-section having a generally circular shape. However, the consumable 1 could equally have a different transverse cross-sectional shape, for example, a generally square, rectangular, or oval shape. The transverse cross-section is generally constant along the longitudinal length of the consumable 1, including at a first longitudinal end face 2 of the consumable.

In a most general sense, the consumable 1 forms an elongate airflow passage which extends from the first longitudinal end face 2 to a second longitudinal end face 3 of the consumable 1. The first longitudinal end face 2 of the consumable 1 may be configured for interaction with a heating device (not shown). The second longitudinal end face 3 of the consumable 1 may be configured to form a mouthpiece. The user may directly engage the second longitudinal end face 3 with their mouth, or a mouthpiece component may be attached to the second longitudinal end face 3, and then, in turn, the user may engage the mouthpiece component. Such a mouthpiece component does not form part of the present invention. The consumable may further comprise a filter 12 (e.g. a cellulose acetate filter, reconstituted tobacco filter or paper filter) adjacent the second longitudinal end face 3 as is known.

As will be appreciated, the first longitudinal end face 2 of the consumable 1 may be considered to represent a so-called "upstream" end of the consumable 1, and the second longitudinal end face 3 of the consumable 1 may be considered to represent a so-called "downstream" end of the consumable 1, in a flow-series sense with respect to the direction of airflow through the consumable 1 along the airflow passage during use.

In use, the user draws (inhales) on the second longitudinal end face 3, which causes airflow into the consumable 1 at the first longitudinal end face 2, through the consumable 1 along the airflow passage, to the second longitudinal end face 3.

The consumable 1 comprises a spirally wound laminar sheet of aluminum foil 4 (a thermally conductive material) such that the aluminum foil has a spiral configuration in the transverse cross section through the consumable 1 (and at the first longitudinal end face 2).

The consumable further comprises a spirally wound laminar sheet of reconstituted tobacco 5 (a plant product) such that the tobacco has a spiral configuration in the transverse cross section through the consumable 1 (and at the first longitudinal end face 2).

The spirals of aluminum foil 4 and tobacco 5 are interleaved (like in a Swiss roll) so that the transverse cross section of the consumable 1 comprises radially alternating spiral layers of aluminum foil 4 and tobacco 5. The layers of aluminum foil 4 and tobacco 5 are in intimate contact/in abutment with one another i.e. there is no spacing/air gap between the layers.

The radial spacing (i.e. the transverse spacing in a radial direction) between each adjacent spiral layer of aluminum foil 4 is equal (i.e. the thickness of the tobacco layer 5 between each aluminum foil layer 4 is equal).

As can be seen from the cut-out portion in FIG. 2, the aluminum foil 4 extends longitudinally without any transverse folds along the length of the consumable. The spacing between each adjacent spiral layer of aluminum foil 4 remains equal along the length of the consumable (i.e. the thickness of the tobacco layer 5 between each aluminum foil layer 4 remains equal along the length of the consumable).

The aluminum foil 4 may be smooth or it may have a textured or discontinuous surface. For example, it may have apertures/perforations/dimples and/or it may have protrusions. For example, the aluminum foil 4 may comprise perforations or dimples each encircled by a protruding annular ring.

The sheet of tobacco may or may not have a textured surface, e.g. it may have a substantially smooth surface.

The consumable further comprises an axially-/longitudinally-extending conductive rod 6 formed of aluminum at the axial centre of the consumable 1.

The conductive rod 6 is thermally coupled to a longitudinal edge 7 of the aluminum foil 4 (or may actually be formed by tightly rolling the longitudinal edge 7 of the aluminum foil).

The conductive rod 6 extends to the first longitudinal end face 2 of the consumable 1 as does the first transverse edge 8 of the spirally wound aluminum foil 4.

The aluminum foil 4 and tobacco 5 are wrapped in a wrapper 10 (e.g. a paper wrapper as is known). The outer surface of the wrapper carries a tubular sheath 11 of aluminum foil.

The consumable 1 may be coupled with a heating element (not shown) in a heat not burn system wherein the heating element comprises a planar surface that abuts the longitudinal end face 2 of the conductive element 1. In this way, the heating element may transfer heat to the transverse edge 8 of the aluminum foil 4 equally across the radial extent of the consumable so that tobacco 5 at the radially outermost portions (adjacent the wrapper 10) of the consumable 1 is heated to the same extent as the tobacco 5 at the radially innermost portion (adjacent the conductive rod 6) of the consumable 1 to ensure even heating.

The heating element may further comprise a tubular portion which encircles and heats the aluminum tubular sheath 11 on the wrapper 10 to transfer heat radially inwards.

In other embodiments, (not shown) the conductive rod 6 protrudes axially from the first longitudinal end face 2.

The heating element may encircle or enclose the protruding conductive rod 6 to provide radial heating to the conductive rod 6 so that it heats quickly and can transfer heat to the spirally wound aluminum foil 4 through its longitudinal edge 7.

The axial heating obtained from heating the transverse edges 8 of the aluminum foil sheet 4 at the first longitudinal end face 2 and/or the radial heating obtained from heat transfer from the conductive rod 6 to the longitudinal edge(s) 7 of the aluminum foil sheet and/or the radial heating obtained from the tubular sheath 11 results in a low thermal gradient in a transverse and/or longitudinal cross section through the consumable. For example, it may be less than or equal to 200° C. after heating in a heating device for 5 minutes.

Figure 3:
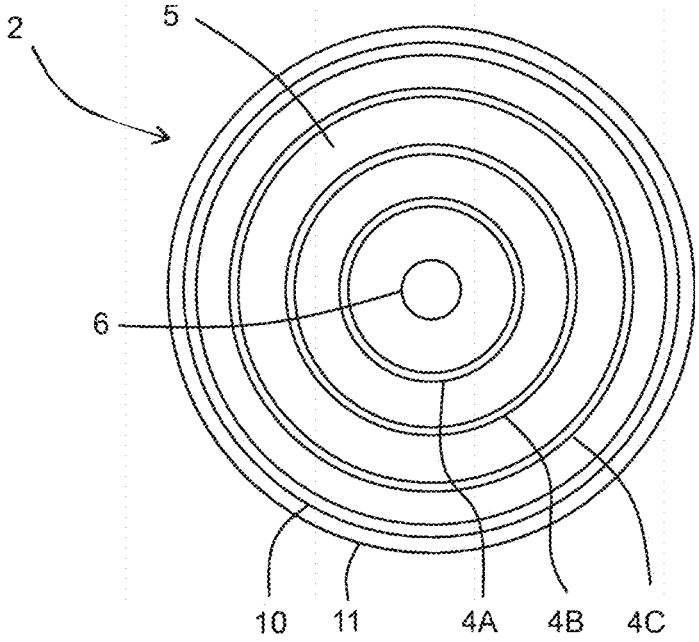
FIG. 3 shows an end view of a second embodiment having a tubular configuration.

FIG. 3 shows a second embodiment which is similar to that shown in FIGS. 1 and 2 except that there is a plurality of longitudinally-extending, axially aligned tubular elements formed of rolled sheets of aluminum foil 4A, 4B, 4C forming radially alternating layers with tubular elements of tobacco 5 such that the transverse cross section (and first longitudinal end face 2) comprises a series of concentric rings.

The radial spacing between each adjacent circular layer of aluminum foil 4 in the transverse cross-section is equal (i.e. the thickness of the tobacco layer 5 between each aluminum foil layer 4 is equal). The adjacent layers are in contact/abutment with one another.

The aluminum foil tubes 4 extends longitudinally along the length of the consumable. The spacing between each adjacent aluminum foil tube 4 remains equal along the length of the consumable (i.e. the thickness of the tobacco layer 5 between each aluminum foil tube 4 remains equal along the length of the consumable).

The tubular aluminum foils 4 extend to and are exposed at the first longitudinal end face 2 for thermal contact with the heating element as described above.

Figure 4:
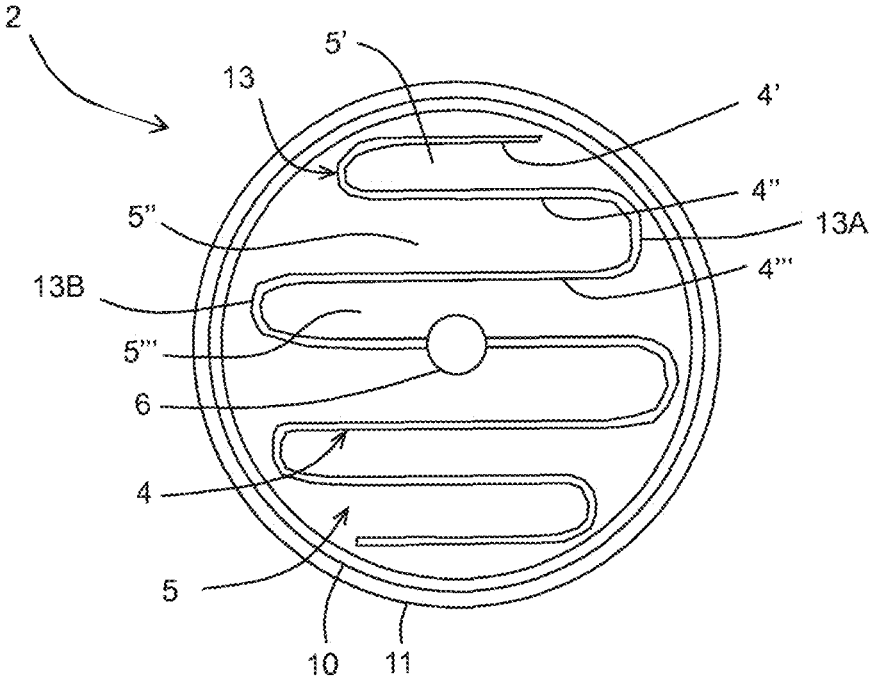
FIG. 4 shows an end view of a third embodiment having a serpentine configuration.

FIG. 4 shows the first longitudinal end face 2 of a third embodiment which is similar to the first and second except that a sheet of aluminum foil 4 is folded to form a series of stacked longitudinally-extending planar layers 4', 4", 4'" etc. separated/spaced at their transverse edges 13, 13A, 13B etc. by a series of longitudinally extending folds in the aluminum foil sheet 4. Each fold at the transverse edges 13, 13A, 13B etc. has a rounded apex. At the first longitudinal end face 2, the aluminum foil 4 has a serpentine configuration.

In this embodiment, the transverse cross-section through the consumable 1 comprises stacked layers 4', 4", 4'" etc. of the aluminum foil alternating with and separated by stacked layers 5', 5", 5'" etc. of tobacco. Adjacent stacked layers are in contact with one another.

The vertical spacing (which may be 0.1 to 0.5 mm) between the stacked layers 4', 4", 4'" of aluminum foil is substantially equal in the transverse cross section of the consumable and remains substantially equal along the length of the consumable 1.

Figure 5:
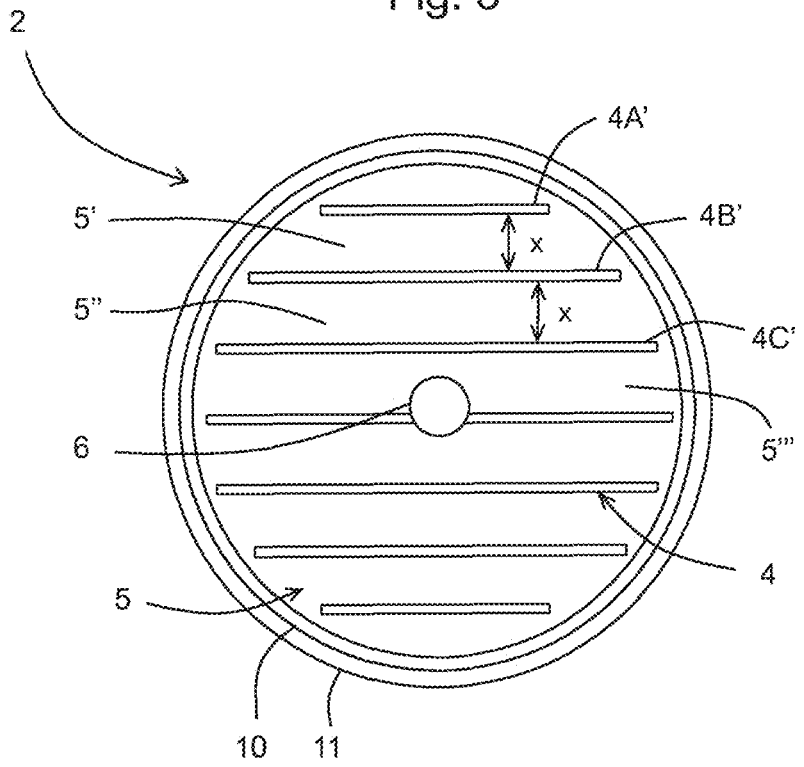
FIG. 5 shows an end view of a fourth embodiment having a laminated configuration.

FIG. 5 shows the first longitudinal end face 2 of a fourth embodiment which is similar to the third except that there is a plurality of stacked longitudinally-extending planar sheets of aluminum foil 4A', 4B", 4C' etc. separated/spaced by stacked layers 5', 5", 5'" etc. of tobacco so that the first longitudinal end face (and the transverse cross section) has a laminated configuration.

The vertical spacing x (which may be 0.1 to 0.5 mm) between the stacked sheets 4A', 4B', 4C' of aluminum foil is substantially equal in the transverse cross section of the consumable and remains substantially equal along the length of the consumable 1. Adjacent stacked layers are in contact with one another.

Figure 6:
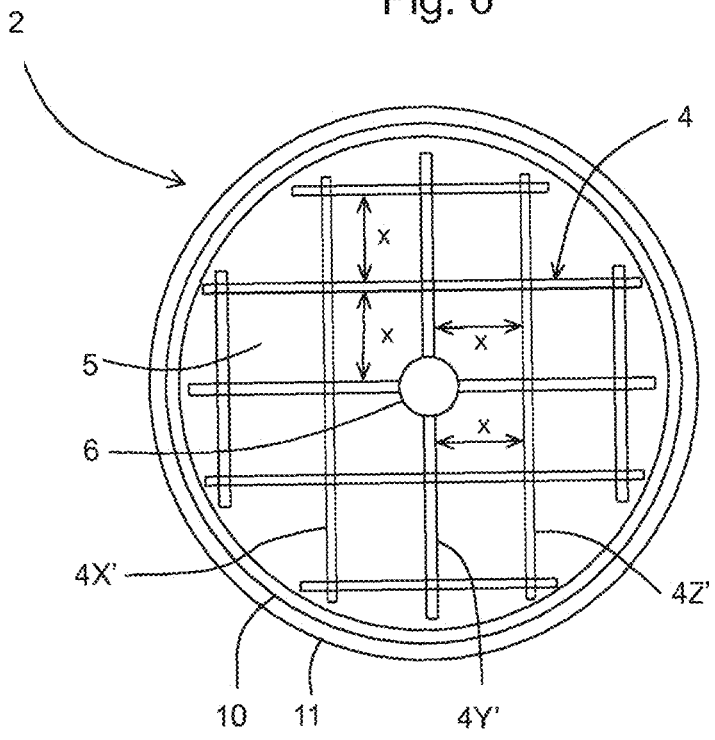
FIG. 6 shows an end view of a fifth embodiment having a reticulated configuration.

FIG. 6 shows the first longitudinal end face 2 of a fifth embodiment which is similar to the fourth except that there is a second plurality of stacked longitudinally-extending planar sheets of aluminum foil 4X', 4Y", 4Z' so that the first longitudinal end face 2 (and the transverse cross section) has a grid of aluminum foil 4.

The vertical spacing x between the stacked sheets aluminum foil is substantially equal in the transverse cross section of the consumable in both the horizontal and vertical directions (such that the transverse cross section comprises a grid of squares of aluminum foil 4) and remains substantially equal along the length of the consumable 1.

Figure 7:
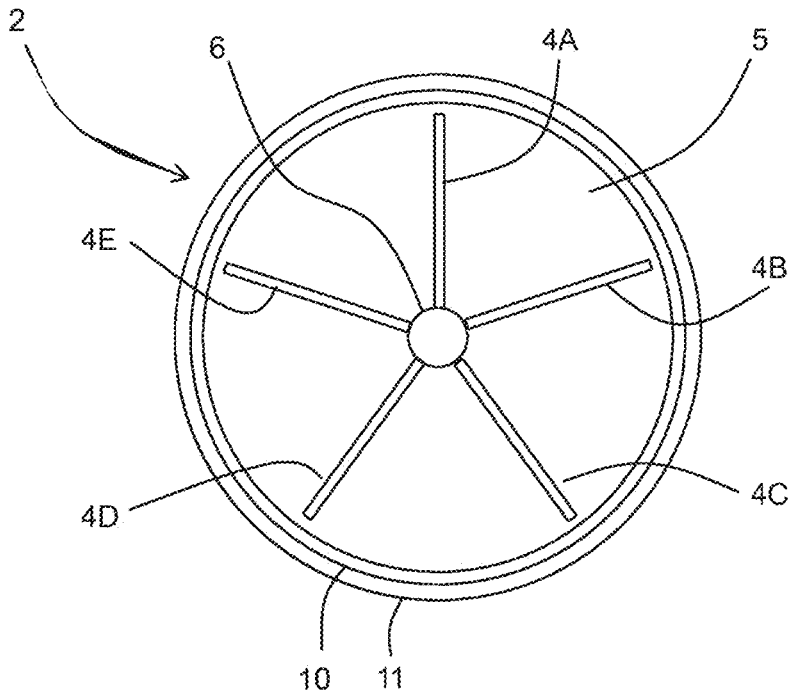
FIG. 7 shows an end view of a sixth embodiment having a spoke configuration.

FIG. 7 shows the first longitudinal end face 2 of a sixth embodiment which is similar to the other embodiments expect there are five radially and longitudinally extending laminar sheets 4A, 4B, 4C, 4D, 4E such that the transverse cross-section through the consumable 1 (and the first longitudinal end face 2) comprises circumferentially alternating layers of tobacco 5 and aluminum foil 4.

Each laminar sheet 4A-4E of aluminum foil extends (in a spoke configuration) from an inner hub formed by the conductive element 6 at the axial centre of the consumable to proximal an outer perimeter of the consumable 1 (adjacent the wrapper 10).

The laminar sheets 4A-4E are equally spaced around the conductive rod 6 i.e. the angular separation between the laminar sheets 4A-4E in a transverse cross section of the consumable (and at the first longitudinal end face 2) is equal (e.g. 72 degrees if there are 5 sheets, 60 degrees if there are 6 sheets etc.) The tobacco 5 is in abutment with the laminar sheets 4A-4E.

It will be appreciated that the regular, ordered, alternating layers of aluminum foil 4 and tobacco 5 provided in the embodiments described above make it possible to provide a more even heating of the tobacco 5 thus reducing burning and incomplete heating of the tobacco by ensuring that each layer of tobacco is heated in a controlled manner by its adjacent layer(s) of aluminum foil 5.

Accordingly, in the embodiments described above, the aluminum foil 4 is configured is configured such that burning of the tobacco 5 is minimised. Indeed, less than 5% of the tobacco 5 is burned after heating in a heating device for 5 minutes. The mass of burned tobacco can be detected from the mass of char present in the consumable 1 after heating.

Furthermore, in the embodiments described above, the aluminum foil 4 is configured is configured such that the amount of unspent tobacco 5 is minimised. Indeed, less than 5% of the tobacco 5 is unspent after heating in a heating device for 5 minutes. The mass of unspent tobacco can be detected from the amount of active substance (nicotine) remaining in the consumable 1 after heating.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the scope of the invention.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

The following numbered paragraphs contain statements of broad combinations of the inventive technical features herein disclosed:—

1. A heat not burn (HNB) consumable comprising a plant product interspersed with a thermally conductive material, wherein a transverse cross-section through the consumable comprises alternating layers of the plant product and the thermally conductive material.

2. A consumable according to paragraph 1 wherein the transverse cross-section through the consumable comprises radially alternating layers of the plant product and the thermally conductive material.

3. A consumable according to paragraph 1 wherein, the transverse cross-section through the consumable comprises stacked alternating layers of the plant product and the thermally conductive material.

4. A consumable according to paragraph 1 wherein the transverse cross-section through the consumable comprises circumferentially alternating layers of the plant product and the thermally conductive material.

5. A consumable according to any one of paragraphs 1 to 4 wherein the thermally conductive material comprises at least one laminar sheet having a planar heating surface extending in a longitudinal direction through the consumable.

6. A consumable according to paragraph 5 comprising a plurality of laminar sheets each having a planar heating surface extending in a longitudinal direction through the consumable.

7. A consumable according to paragraph 5 or 6 wherein the laminar sheet(s) are longitudinally folded or rolled to form the layers of thermally conductive material within the transverse cross-section.

8. A consumable according to any one of paragraphs 5 to 7 further comprising a longitudinally-extending conductive element formed of the or a further thermally conductive material.

9. A consumable according to paragraph 8 wherein the conductive element is thermally coupled to the or each laminar sheet of thermally conductive material.

10. A heat not burn (HNB) system comprising:

a heat not burn consumable according to any one of paragraphs 1 to 9 and having a first longitudinal end face;

and a heating element, wherein the heating element abuts the first longitudinal end face of the consumable.

11. A heat not burn (HNB) consumable comprising a plant product interspersed with a thermally conductive material, wherein both the plant product and the thermally conductive material have a spiral configuration in a transverse cross-section through the consumable, the spiral cross sections being interleaved with one another.

12. A consumable according to paragraph 11 wherein the thermally conductive material comprises at least one laminar sheet extending in a longitudinal direction through the consumable and rolled longitudinally to form a spiral configuration.

13. A consumable according to paragraph 12 comprising a plurality of laminar sheets of thermally conductive material rolled into a plurality of interleaved spiral configurations of thermally conductive material.

14. A consumable according to paragraph 12 or 13 wherein the plant product comprises at least one laminar sheet extending in a longitudinal direction through the consumable and rolled longitudinally to form a spiral configuration.

15. A consumable according to any one of the preceding paragraphs 11 to 14 wherein the radial spacing between at least three adjacent spiral layers of thermally conductive material is substantially equal in the transverse cross section of the consumable.

16. A consumable according to paragraph 15 wherein the radial spacing between at least two adjacent spiral layers of thermally conductive material remains substantially equal along the length of the consumable.

17. A consumable according to paragraph 15 wherein the radial spacing between substantially all of the spiral layers of thermally conductive material is substantially equal in the transverse cross section of the consumable.

18. A consumable according to paragraph 17 wherein the radial spacing between substantially all of the spiral layers of thermally conductive material remains substantially equal along the length of the consumable.

19. A consumable according to any one of paragraphs 12 to 18 further comprising a longitudinally-extending conductive element formed of the or a further thermally conductive material.

20. A consumable according to paragraph 19 wherein the conductive element is thermally coupled to the or each laminar sheet of thermally conductive material.

21. A consumable according to paragraph 20 wherein the or each laminar sheet comprises a longitudinal edge which is coupled to the conductive element which forms the axial centre of the spiral configuration(s).

22. A heat not burn (HNB) system comprising:

a heat not burn consumable according to any one of paragraphs 11 to 21 and having a first longitudinal end face, and a heating element, wherein the heating element abuts the first longitudinal end face of the consumable.

23. A heat not burn (HNB) consumable comprising a plant product interspersed with a thermally conductive material, wherein the thermally conductive material comprises at least one longitudinally-extending tubular element.

24. A consumable according to paragraph 23 wherein the thermally conductive material comprises at least one laminar sheet extending in a longitudinal direction through the consumable and rolled longitudinally to form the at least one tubular element.

25. A consumable according to paragraph 23 or paragraph 24 comprising a plurality of tubular elements of thermally conductive material.

26. A consumable according to paragraph 25 wherein the tubular elements are axially aligned such that, in the transverse cross section, the thermally conductive material forms a series of concentric rings interleaved with concentric rings of plant product.

27. A consumable according to paragraph 26 wherein the radial spacing between at least three adjacent rings of thermally conductive material is substantially equal in the transverse cross section of the consumable.

28. A consumable according to paragraph 27 wherein the radial spacing between at least two of the tubular elements of thermally conductive material remains substantially equal along the length of the consumable.

29. A consumable according to paragraph 27 wherein the radial spacing between substantially all of the rings of thermally conductive material is substantially equal in the transverse cross section of the consumable.

30. A consumable according to paragraph 29 wherein the radially spacing between substantially all of the tubular elements of thermally conductive material remains substantially equal along the length of the consumable.

31. A consumable according to any one of paragraphs 24 to 30 further comprising a longitudinally-extending conductive element at the axial centre of the consumable formed of the or a further thermally conductive material.

32. A heat not burn (HNB) system comprising:

a heat not burn consumable according to any one of paragraphs 24 to 31 and having a first longitudinal end face;

and a heating element, wherein the heating element abuts the first longitudinal end face of the consumable.

33. A heat not burn (HNB) consumable comprising a plant product interspersed with a thermally conductive material, wherein the thermally conductive material comprises a plurality of radially and longitudinally extending laminar sheets.

34. A consumable according to paragraph 33 comprising at least five radially and longitudinally extending laminar sheets of thermally conductive material.

35. A consumable according to paragraph 33 or 34 wherein the angular separation between the laminar sheets in a transverse cross section of the consumable is equal.

36. A consumable according to any one of paragraphs 33 to 35 further comprising a longitudinally-extending conductive element at the axial centre of the consumable formed of the or a further thermally conductive material.

37. A consumable according to paragraph 36 wherein each laminar sheet extends from the conductive element to an outer perimeter of the consumable.

38. A consumable according to paragraph 37 wherein the laminar sheets are equally spaced around the perimeter of the conductive element.

39. A consumable according to paragraph 37 or 38 where each laminar sheet has a longitudinal edge thermally coupled to the conductive element.

40. A heat not burn (HNB) system comprising:

a heat not burn consumable according to any one of paragraphs 33 to 39 and having a first longitudinal end face;

and a heating element, wherein the heating element abuts the first longitudinal end face of the consumable.

41. A heat not burn (HNB) consumable comprising a plant product interspersed with a thermally conductive material, wherein the thermally conductive material has a boustrophedonic configuration in a transverse cross-section through the consumable.

42. A consumable according to paragraph 41 wherein the thermally conductive material has a serpentine configuration in a transverse cross-section through the consumable.

43. A consumable according to paragraph 41 wherein the thermally conductive material has a concertina configuration in a transverse cross-section through the consumable.

44. A consumable according to any one of paragraphs 41 to 43 wherein the thermally conductive material comprises at least one laminar sheet extending in a longitudinal direction through the consumable and folded longitudinally to form the boustrophedonic/serpentine/concertina configuration.

45. A consumable according to paragraph 44 wherein said at least one laminar sheet is configured to form a series of longitudinally-extending planar layers separated/spaced at their transverse edges by a series of longitudinally extending rolls in the laminar sheet.

46. A consumable according to paragraph 45 wherein the spacing between at least three adjacent planar layers of thermally conductive material is substantially equal in the transverse cross section of the consumable.

47. A consumable according to paragraph 46 wherein the spacing between at least two adjacent planar layers of thermally conductive material remains substantially equal along the length of the consumable.

48. A consumable according to paragraph 46 wherein the spacing between substantially all of the planar layers of thermally conductive material is substantially equal in the transverse cross section of the consumable.

49. A consumable according to paragraph 48 wherein the spacing between substantially all of the planar layers of thermally conductive material remains substantially equal along the length of the consumable.

50. A consumable according to any one of paragraphs 44 to 49 further comprising a longitudinally-extending conductive element formed of the or a further thermally conductive material.

51. A consumable according to paragraph 50 wherein the conductive element is thermally coupled to the or each laminar sheet of thermally conductive material.

52. A heat not burn (HNB) system comprising:

a heat not burn consumable according to any one of paragraphs 41 to 51 and having a first longitudinal end face, and a heating element, wherein the heating element abuts the first longitudinal end face of the consumable.

53. A heat not burn (HNB) consumable comprising a plant product and a thermally conductive material, wherein the thermally conductive material comprises a plurality of stacked, longitudinally-extending laminar sheets interspersed with plant product.

54. A consumable according to paragraph 53 wherein the spacing between at least three adjacent laminar sheets of thermally conductive material is substantially equal in the transverse cross section of the consumable.

55. A consumable according to paragraph 54 wherein the spacing between at least two adjacent laminar sheets of thermally conductive material remains substantially equal along the length of the consumable.

56. A consumable according to paragraph 54 wherein the spacing between substantially all of the laminar sheets of thermally conductive material is substantially equal in the transverse cross section of the consumable.

57. A consumable according to paragraph 56 wherein the spacing between substantially all of the laminar sheets of thermally conductive material remains substantially equal along the length of the consumable.

58. A consumable according to any one of paragraphs 54 to 57 wherein the spacing is between 0.1 and 0.5 mm.

59. A consumable according to any one of the preceding paragraphs 53 to 58 further comprising a longitudinally-extending conductive element formed of the or a further thermally conductive material.

60. A consumable according to paragraph 59 wherein the conductive element is thermally coupled to one or more of the laminar sheets of thermally conductive material.

61. A heat not burn (HNB) system comprising:

a heat not burn consumable according to any one of paragraphs 53 to 60 and having a first longitudinal end face, and a heating element, wherein the heating element abuts the first longitudinal end face of the consumable.

62. A heat not burn (HNB) consumable comprising a plant product and a thermally conductive material, wherein the thermally conductive material comprises a first plurality of stacked, longitudinally-extending laminar sheets and a second plurality of stacked, longitudinally extending laminar sheets, the first and second plurality of laminar sheets intersecting each other to form a grid of thermally conductive material interspersed with plant product in a transverse direction of the consumable.

63. A consumable according to paragraph 62 wherein the spacing between each of the laminar sheets in the first plurality of laminar sheets of thermally conductive material is substantially equal in the transverse cross section of the consumable.

64. A consumable according to paragraph 63 wherein the spacing between each of the laminar sheets in the first plurality of laminar sheets of thermally conductive material remains substantially equal along the length of the consumable.

65. A consumable according to any one of paragraphs 62 to 64 wherein the spacing between each of the laminar sheets in the second plurality of laminar sheets of thermally conductive material is substantially equal in the transverse cross section of the consumable.

66. A consumable according to paragraph 65 wherein the spacing between each of the laminar sheets in the second plurality of laminar sheets of thermally conductive material remains substantially equal along the length of the consumable.

67. A consumable according to any one of paragraphs 63 to 66 wherein the spacing is between 0.1 and 0.5 mm.

68. A consumable according to any one of the preceding paragraphs 62 to 67 further comprising a longitudinally-extending conductive element formed of the or a further thermally conductive material.

69. A consumable according to paragraph 68 wherein the conductive element is thermally coupled to one or more of the laminar sheets of thermally conductive material.

70. A heat not burn (HNB) system comprising:

a heat not burn consumable according to any one of paragraphs 1 to 69 and having a first longitudinal end face;

and a heating element, wherein the heating element abuts the first longitudinal end face of the consumable.

71. A heat not burn (HNB) consumable comprising a plant product and at least one longitudinally-extending laminar sheet of thermally conductive material, wherein the at least one laminar sheet comprises a plurality of longitudinal folds and wherein each of the plurality of longitudinal folds has a rounded apex.

72. A consumable according to paragraph 71 wherein the at least one laminar sheet comprises only longitudinal folds and no transverse folds.

73. A heat not burn (HNB) consumable comprising a plant product and at least one longitudinally-extending laminar sheet of thermally conductive material, wherein the at least one laminar sheet comprises a plurality of longitudinal folds and no transverse folds.

74. A consumable according to paragraph 73 wherein each of the plurality of longitudinal folds has a rounded apex.

75. A consumable according to any one of the preceding paragraphs 71 to 74 wherein the thermally conductive material has a boustrophedonic configuration in a transverse cross-section through the consumable.

76. A consumable according to paragraph 75 wherein the thermally conductive material has a serpentine configuration in a transverse cross-section through the consumable.

77. A consumable according to any one of the preceding paragraphs 71 to 76 wherein said at least one laminar sheet is configured to form a series of longitudinally-extending planar layers separated/spaced at their transverse edges by the plurality of longitudinal folds in the laminar sheet.

78. A consumable according to paragraph 77 wherein the spacing between at least three adjacent planar layers of thermally conductive material is substantially equal in the transverse cross section of the consumable.

79. A consumable according to paragraph 78 wherein the spacing between at least adjacent two planar layers of thermally conductive material remains substantially equal along the length of the consumable.

80. A consumable according to paragraph 78 wherein the spacing between substantially all of the planar layers of thermally conductive material is substantially equal in the transverse cross section of the consumable.

81. A consumable according to paragraph 80 wherein the spacing between substantially all of the planar layers of thermally conductive material remains substantially equal along the length of the consumable.

82. A heat not burn (HNB) system comprising:

a heat not burn consumable according to any one of paragraphs 71 to 81 and having a first longitudinal end face;

and a heating element, wherein the heating element abuts the first longitudinal end face of the consumable.

83. A heat not burn (HNB) consumable comprising a plant product interspersed with a thermally conductive material, wherein the thermally conductive material comprises a longitudinally-extending conductive element which protrudes axially from a longitudinal end face of the consumable.

84. A consumable according to paragraph 83 wherein the thermally conductive material further comprises at least one laminar sheet of the or a further thermally conductive material.

85. A consumable according to paragraph 84 wherein the or each laminar sheet of thermally conductive material is thermally coupled to the conductive element.

86. A consumable according to paragraph 85 wherein the or each laminar sheet of thermally conductive material has a longitudinal edge joined to the conductive element.

87. A consumable according to any one of paragraphs 84 to 86 wherein a transverse cross-section through the consumable comprises radially, circumferentially or stacked alternating layers of the plant product and the thermally conductive material.

88. A consumable according to paragraph 87 wherein the thermally conductive material has a spiral, serpentine, circular, reticulated or laminate configuration in the transverse cross-section.

89. A consumable according to paragraph 87 or 88 wherein a spacing between adjacent layers of the thermally conductive material is substantially equal in the transverse cross section.

90. A consumable according to paragraph 89 wherein the spacing between adjacent layers of the thermally conductive material is substantially equal along the length of the consumable.

91. A consumable according to any one of the preceding paragraphs 83 to 90 wherein the conductive element is a conductive rod having a circular or oval transverse cross-section.

92. A heat not burn (HNB) system comprising:

a heat not burn consumable according to any one of paragraphs 83 to 91;

and a heating element, wherein the heating element surrounds the protruding conductive element.

93. A system according to paragraph 92 wherein the consumable has a first longitudinal end face and the heating element abuts the first longitudinal end face of the consumable.

94. A heat not burn (HNB) system comprising:

a heat not burn consumable having a having a first longitudinal end face, the consumable comprising a plant product interspersed with a thermally conductive material;

and a heating element, wherein the heating element abuts the first longitudinal end face of the consumable.

95. A system according to paragraph 94 wherein the thermally conductive material extends to the first longitudinal end face for thermal abutment with the heating element.

96. A system according to paragraph 95 wherein the thermally conductive material is exposed at the first longitudinal end face for thermal abutment with the heating element.

97. A system according to any one of the preceding paragraphs 93 to 96 wherein the longitudinal end face of the consumable comprises radially, circumferentially or stacked alternating layers of the plant product and the thermally conductive material.

98. A system according to paragraph 97 wherein a spacing between adjacent layers of the thermally conductive material is substantially equal in the transverse cross section.

99. A system according to paragraph 98 wherein the spacing between adjacent layers of the thermally conductive material is substantially equal along the length of the consumable.

100. A system according to anyone of the preceding paragraphs 94 to 99 wherein the thermally conductive material comprises at least one laminar sheet having a planar heating surface extending in a longitudinal direction through the consumable and having a transverse edge which extends to and is exposed at the longitudinal end face of the consumable.

101. A system according to paragraph 100 wherein the transverse edge of the at least one laminar sheet of thermally conductive material has a spiral, serpentine, circular, reticulated or laminate configuration in the transverse cross-section.

102. A system according to any one of the preceding paragraphs 94 to 101 wherein the heating element comprises a planar heating surface for abutment with the first longitudinal end face of the consumable.

103. A system according to any one of the preceding paragraphs 94 to 102 wherein an outer surface of the consumable comprises a tubular sheath formed of the or a further thermally conductive material and the heating element further comprises a tubular portion which thermally contacts the tubular sheath.

104. A heat not burn (HNB) consumable comprising a plant product interspersed with a thermally conductive material, wherein a transverse cross-section through the consumable comprises layers of the plant product and the thermally conductive and wherein a transverse spacing between two adjacent layers of thermally conductive material is substantially equal along a major portion of the length of the consumable.

105. A consumable according to paragraph 104 wherein the transverse spacing between substantially all adjacent layers of thermally conductive material is substantially equal along a major portion of the length of the consumable.

106. A consumable according to paragraph 104 or 105 wherein the transverse spacing between substantially all adjacent layers of thermally conductive material is substantially equal in a transverse cross-section through the consumable.

107. A consumable according to paragraph 105 wherein the transverse spacing between substantially all adjacent layers of thermally conductive material is substantially equal along a major portion of the length of the consumable.

108. A consumable according to any one of the preceding paragraphs 104 to 107 wherein the transverse cross-section through the consumable comprises radially alternating layers of the plant product and the thermally conductive material and the transverse spacing in a radial direction between two adjacent layers of thermally conductive material is substantially equal along a major portion of the length of the consumable.

109. A consumable according to any one of paragraphs 104 to 107 wherein, the transverse cross-section through the consumable comprises stacked alternating layers of the plant product and the thermally conductive material.

110. A consumable according to any one of the preceding paragraphs 104 to 109 wherein the transverse spacing is between 0.1 and 0.5 mm.

111. A heat not burn (HNB) system comprising:

a heat not burn consumable according to any one of paragraphs 104 to 110 and having a first longitudinal end face;

and a heating element, wherein the heating element abuts the first longitudinal end face of the consumable.

112. A heat not burn (HNB) consumable comprising at least one laminar sheet of plant product and at least one laminar sheet of thermally conductive material, wherein a surface of the at least one sheet of plant product is substantially smooth and wherein a surface of the at least one sheet of thermally conductive material is textured.

113. A consumable according to paragraph 112 wherein the at least one laminar sheet of thermally conductive material has an apertured/perforated, dimpled or recessed surface.

114. A consumable according to paragraph 112 or 113 wherein the at least one laminar sheet of thermally conductive material has protrusions or ridges.

115. A consumable according to paragraph 114 wherein the at least one laminar sheet of thermally conductive material is a crimped sheet.

116. A consumable according to any one of paragraphs 112 to 114 wherein the at least one laminar sheet of thermally conductive material has a series of perforations wherein each perforation is at least partly encircled by a respective ridge.

117. A consumable according to any one of the preceding paragraphs 112 to 116 wherein a transverse cross-section through the consumable comprises radially, circumferentially or stacked alternating layers of the plant product and the thermally conductive material.

118. A consumable according to paragraph 117 wherein the thermally conductive material has a spiral, serpentine, circular, reticulated or laminate configuration in the transverse cross-section.

119. A consumable according to paragraph 117 or 118 wherein a spacing between adjacent layers of the thermally conductive material is substantially equal in the transverse cross section.

120. A consumable according to paragraph 119 wherein the spacing between adjacent layers of the thermally conductive material is substantially equal along the length of the consumable.

121. A heat not burn (HNB) system comprising:

a heat not burn consumable according to any one of paragraphs 112 to 120 and having a first longitudinal end face, and a heating element, wherein the heating element abuts the first longitudinal end face of the consumable.

122. A heat not burn (HNB) consumable comprising a plant product interspersed with a thermally conductive material, wherein the thermally conductive material is configured such that burning of the plant product is minimised.

123. A consumable according to paragraph 122 wherein the thermally conductive material is configured such that less than 10% of plant product is burned after heating in a heating device for 5 minutes.

124. A consumable according to paragraph 123 wherein the thermally conductive material is configured such that less than 5% of plant product is burned after heating in a heating device for 5 minutes.

125. A heat not burn (HNB) consumable comprising a plant product interspersed with a thermally conductive material, wherein the thermally conductive material is configured such that the amount of unspent plant product present after heating is minimised.

126. A consumable according to paragraph 125 wherein the thermally conductive material is configured such that less than 10% of unspent plant product remains after heating in a heating device for 5 minutes.

127. A consumable according to paragraph 126 wherein the thermally conductive material is configured such that less than 5% of unspent plant product remains after heating in a heating device for 5 minutes.

128. A heat not burn (HNB) consumable comprising a plant product interspersed with a thermally conductive material, wherein the thermally conductive material is configured such that the thermal gradient in a transverse and/or longitudinal cross section through the consumable is less than or equal to 50° C.

129. A heat not burn (HNB) consumable according to paragraph 128 wherein the thermally conductive material is configured such that the thermal gradient in a transverse and/or longitudinal cross section through the consumable is less than or equal to 40° C.

130. A heat not burn (HNB) consumable according to paragraph 129 wherein the thermally conductive material is configured such that the thermal gradient in a transverse and/or longitudinal cross section through the consumable is less than or equal to 30° C.

131. A heat not burn (HNB) consumable according to paragraph 130 wherein the thermally conductive material is configured such that the thermal gradient in a transverse and/or longitudinal cross section through the consumable is less than or equal to 20° C.

132. A heat not burn (HNB) consumable according to paragraph 131 wherein the thermally conductive material is configured such that the thermal gradient in a transverse and/or longitudinal cross section through the consumable is less than or equal to 10° C.

We claim:

1. A heat not burn consumable comprising:

a solid plant product interspersed with a thermally conductive material;

wherein a transverse cross-section through the consumable comprises circumferentially alternating layers of the plant product and the thermally conductive material;

further comprising a longitudinally-extending conductive element at the axial center of the consumable formed of the thermally conductive material or a further thermally conductive material;

wherein the longitudinally-extending conductive element is a solid rod.

2. A heat not burn consumable comprising:

a plant product interspersed with a thermally conductive material;

wherein the plant product comprises laminar sheets having a smooth surface; and wherein the thermally conductive material comprises laminar sheets having a textured surface;

wherein a transverse cross-section through the heat not burn consumable comprises circumferentially alternating layers of the plant product and the thermally conductive material.

3. A heat not burn unit comprising:

a heat not burn consumable having a having a first longitudinal end face, the consumable comprising a plant product interspersed with a thermally conductive material; and a heating element abutting the first longitudinal end face of the consumable;

wherein an outer surface of the consumable comprises a tubular sheath formed of a thermally conductive material comprising carbon, metal and/or metal alloy and the heating element further comprises a tubular portion which thermally contacts the tubular sheath;

wherein the first longitudinal end face of the consumable comprises circumferentially alternating layers of the plant product and the thermally conductive material.

4. The heat not burn unit of claim 3 wherein the thermally conductive material comprises a longitudinally-extending conductive element which protrudes axially from the longitudinal end face of the consumable.

5. The heat not burn consumable according to claim 1, wherein the thermally conductive material comprises at least one laminar sheet having a planar heating surface extending in a longitudinal direction through the consumable.

6. The heat not burn consumable according to claim 5, comprising a plurality of laminar sheets each having a planar heating surface extending in a longitudinal direction through the consumable.

7. The heat not burn consumable according to claim 1, wherein the thermally conductive material comprises a plurality of radially and longitudinally extending laminar sheets.

8. The heat not burn consumable according to claim 7 comprising at least five radially and longitudinally extending laminar sheets of thermally conductive material.

9. The heat not burn consumable according to claim 7, wherein angular separation between the laminar sheets in a transverse cross section of the consumable is equal.

10. The heat not burn consumable according to claim 5, wherein the conductive element is thermally coupled to the or each laminar sheet of thermally conductive material.

11. The heat not burn consumable according to claim 5, wherein the laminar sheets extend from the conductive element to an outer perimeter of the consumable.

12. The heat not burn consumable according to claim 9, wherein the laminar sheets are equally spaced around the perimeter of the conductive element.

13. The heat not burn consumable according to claim 5, wherein the or each laminar sheet has a longitudinal edge thermally coupled to the conductive element.

14. A heat not burn system comprising:

a heat not burn consumable according to claim 1 and having a first longitudinal end face; and a heating element, wherein the heating element abuts the first longitudinal end face of the consumable.

15. A system according to claim 14, wherein the thermally conductive material extends to the first longitudinal end face for thermal abutment with the heating element.

16. A system according to claim 15, wherein the thermally conductive material is exposed at the first longitudinal end face for thermal abutment with the heating element.

17. A system according to claim 16, wherein the thermally conductive material comprises at least one laminar sheet having a planar heating surface extending in a longitudinal direction through the consumable and having a transverse edge which extends to and is exposed at the longitudinal end face of the consumable.

18. A system according to claim 17, wherein a transverse edge of the at least one laminar sheet of thermally conductive material has a spiral, serpentine, circular, reticulated or laminate configuration in the transverse cross-section.

* * * * *